US007171765B2

(12) United States Patent
Lo

(10) Patent No.: US 7,171,765 B2
(45) Date of Patent: Feb. 6, 2007

(54) AIRFLOW ADJUSTING DEVICE OF AIR CUSHION SHOE

(76) Inventor: Chie-Fang Lo, 235 Chung-Ho Box 8-24, Taipei (TW)

( * ) Notice: Subject to any disclaimer, the term of this patent is extended or adjusted under 35 U.S.C. 154(b) by 339 days.

(21) Appl. No.: 10/827,223

(22) Filed: Apr. 20, 2004

(65) Prior Publication Data

US 2005/0229432 A1 Oct. 20, 2005

(51) Int. Cl.
*A43B 13/20* (2006.01)

(52) U.S. Cl. ..... 36/29; 36/35 B; 36/3 B

(58) Field of Classification Search ..... 36/28, 36/29, 3 B, 3 R, 35 B
See application file for complete search history.

(56) References Cited

U.S. PATENT DOCUMENTS 4,446,634 A * 5/1984 Johnson et al. ..... 36/29
5,794,361 A * 8/1998 Sadler ..... 36/29
6,085,444 A * 7/2000 Cho ..... 36/3 B
6,510,624 B1 * 1/2003 Lakic ..... 36/29
2002/0139471 A1 * 10/2002 Tawney et al. ..... 156/205

* cited by examiner

*Primary Examiner*—Jila M. Mohandesi

(57) ABSTRACT

An airflow adjusting device is used in an air cushion shoe and includes an air cushion body having a buffer portion, an air inlet connected to the buffer portion and an air outlet connected to the buffer portion. When the buffer portion is impacted, the buffer portion will be compressed and thus induce an elastic force to have a buffer effect. When the buffer portion is compressed, air in the buffer portion will be drained out from the air outlet. When the compressing force disappears, the buffer portion will restore and air is sucked from the air inlet. An adjusting device including an adjusting seat and an adjusting button screwed on the adjusting seat; and a stopper being formed on the adjusting button for changing air flow rate of the air flowing out of the air outlet so as to change the elasticity of the buffer portion.

2 Claims, 6 Drawing Sheets

AIRFLOW ADJUSTING DEVICE OF AIR CUSHION SHOE

FIELD OF THE INVENTION

The present invention relates to air cushion shoes, and particular to a airflow adjusting device of an air cushion shoe, wherein the airflow adjusting device has a buffer portion so that the impacts applied to the sole of the air cushion shoe is adjustable to match the requirement of different exercise.

BACKGROUND OF THE INVENTION

Air cushion shoes have become a popular trend of current shoes since the air cushion shoes provide elastic soles to users so as to buffer the impact applied on the bottoms of the legs. Moreover, the air cushion shoes increase the efficiency in exercises.

In the prior art, an air cushion shoe includes an air cushion body, a sole layer and a shoe cushion. The shoe cushion has a plurality of air holes. The air cushion body includes an air suction compressing chamber, an air valve, and a heel pump. A buffer block is installed at the rear end of the shoe cushion for actuating the heel pump so as to provide a buffer force as the shoe treads on the ground. Thereby, by the structure of the air cushion body, sole layer and shoe cushion, the sole of the shoes has the effects of air exchange and shock-proof.

However, in the prior art, the buffering effect of the air cushion shoe is fixedly confined by the structure of the shoe, which is determined in the manufacturing process of the air cushion shoe, but in practical, the impacts upon the sole of an air cushion shoe are different according to the kinds of exercises. For example, in walking, the impact is smaller, while in playing basketball, the impact is very large, but the prior art design has only fixed buffer effect. The buffer force of the air cushion body is unadjustable. Thereby, the feet of the user cannot have a preferred protection.

SUMMARY OF THE INVENTION

Accordingly, the primary object of the present invention is to provide an airflow adjusting device of an air cushion shoe, wherein the airflow adjusting device has a buffer portion so that the impacts applied to the sole of the air cushion shoe is adjustable to match the requirement of different exercise.

To achieve above object, the present invention provides an airflow adjusting device of an air cushion shoe. The airflow adjusting device comprises an air cushion body having a buffer portion, an air inlet connected to the buffer portion and an air outlet connected to the buffer portion. When the buffer portion is impacted, the buffer portion will be compressed and thus induce an elastic force to have a buffer effect. When the buffer portion is compressed, air in the buffer portion will be drained out from the air outlet. When the compressing force disappears, the buffer portion will restore and air is sucked from the air inlet. An adjusting device includes an adjusting seat and an adjusting button screwed on the adjusting seat; and a stopper being formed on the adjusting button for changing air flow rate of the air flowing out of the air outlet so as to change the elasticity of the buffer portion.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
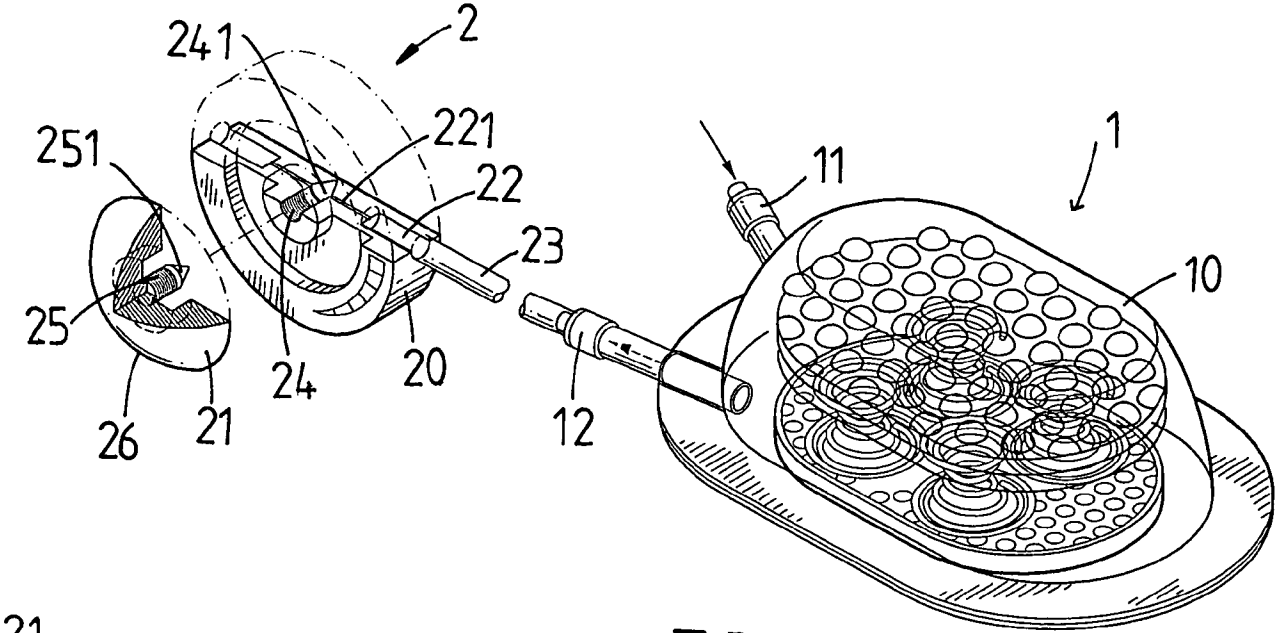
FIG. 1 is a partial exploded view of the airflow adjusting device of an air cushion shoe of the present invention.
Figure 2:
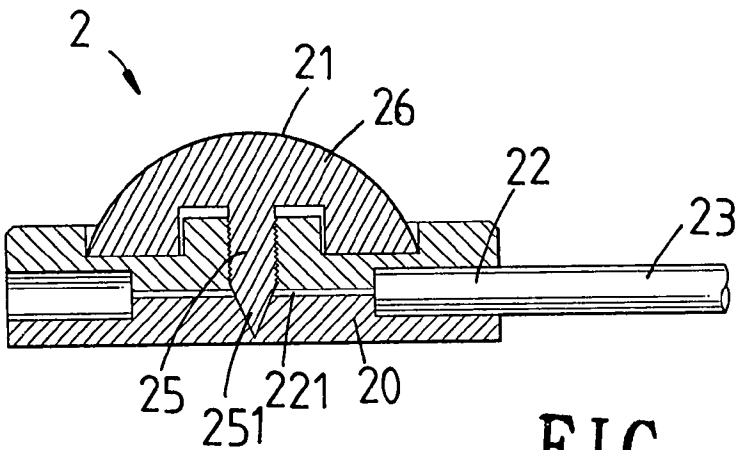
FIG. 2 is a cross section view about the adjusting device of the present invention.
Figure 3:
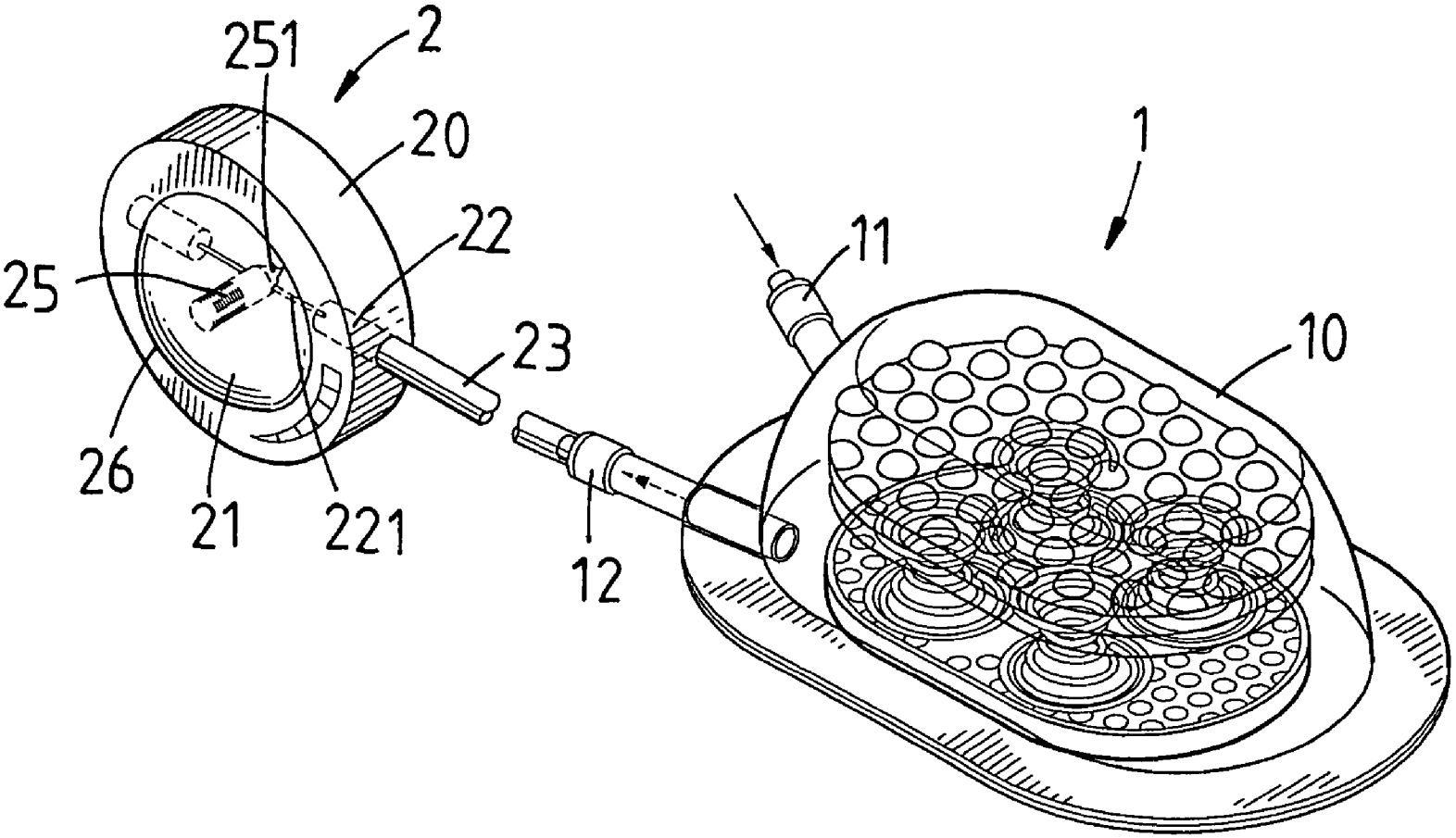
FIG. 3 is a perspective view of the air cushion body of the airflow adjusting device of the present invention.

With reference to FIG. 1, the airflow adjusting device of an air cushion shoe of the present invention is illustrated. The air adjusting device of the present invention has the following elements.

An air cushion body 1 has a buffer portion 10, an air inlet 11 connected to the buffer portion 10 and an air outlet 12 connected to the buffer portion 10. When the buffer portion 10 is impacted, the buffer portion 10 will be compressed and thus induce an elastic force to have a buffer effect. When the buffer portion 10 is compressed, air in the buffer portion 10 will be drained out from the air outlet 12. When the compressing force disappears, the buffer portion 10 will restore and air is sucked from the air inlet 11. Thereby, the air cushion shoe has a vibration-proof effect.

An adjusting device 2 includes an approximate round adjusting seat 20 and an approximate hemispherical adjusting button 21. An exhausting channel 22 penetrating through two sides of the adjusting seat 20 is formed within the adjusting seat 20. A middle section of the exhausting channel 22 is formed with an air slot 221 having a smaller diameter than that of the exhausting channel 22. A guide tube 23 serves to connect the air outlet 12 of the air cushion body 1 with the exhausting channel 22 of the adjusting device 2. An upper center of the adjusting seat 20 is formed with a screw hole 24. A tapered space is formed in the adjusting seat 20 and below the screw hole 24. The tapered space overlaps with one section of the air slot 221.

A center of a lateral side of the hemispherical adjusting button 21 is installed with a screwed post 26 for screwing the screw hole 24 of the adjusting seat 20. A front end of the screwed post 26 is formed with a stopper 251 corresponding to the tapered space 241 of the adjusting seat 20. The adjusting button 21 has a cambered side 26 for being pushed by a user.

By above said structure, the screw post 25*f* the adjusting button 21 is screwed into the screw hole 24 of the adjusting seat 20 and the stopper 251 of the screw post 25 is received in the tapered space 241. Then guide tube 23 serves to connect the air outlet 12 of the air cushion body 1 to the exhausting channel 22 of the adjusting device 2. Thus, assembly of the present invention is complete.

Figure 4:
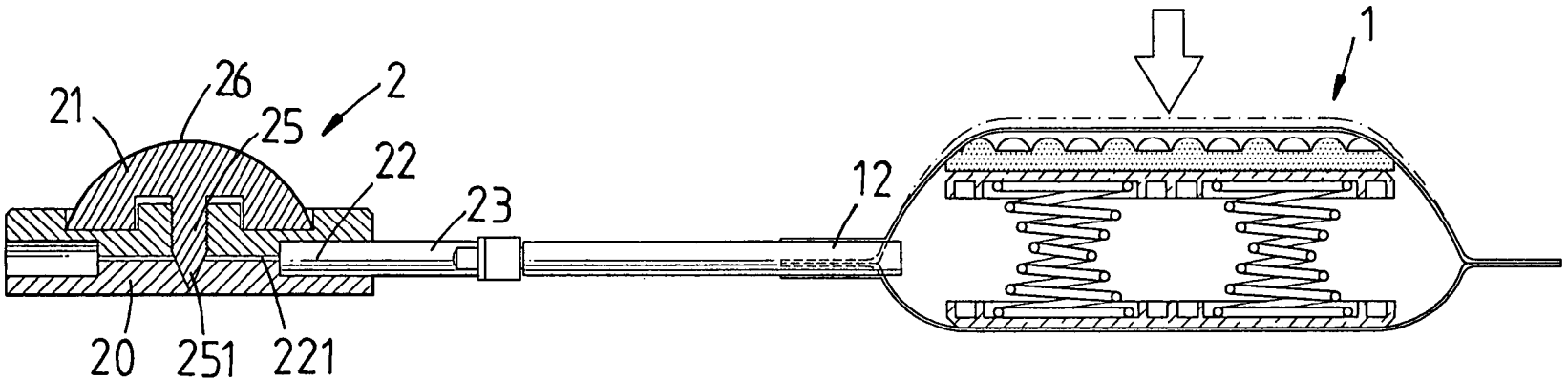
FIGS. 4, 5 and 6 are cross section views about the operation of the air cushion body of the present invention.

In use of the present invention, referring to FIG. 4, when the adjusting button 21 of the adjusting device 2 is tightened. The screw post 25 will screw into the screw hole 24 so as to be received in the tapered space 241. Moreover, the overlapped portions of the vent 221 and the tapered 241 are cut out so that the air at the two ends of the vent 221 and the exhausting channel 22 can not flow out successfully. Thereby, it can not be compressed easily and thus the airflow adjusting device is elastic to be suitable for exercises with larger impacts.

Figure 5:
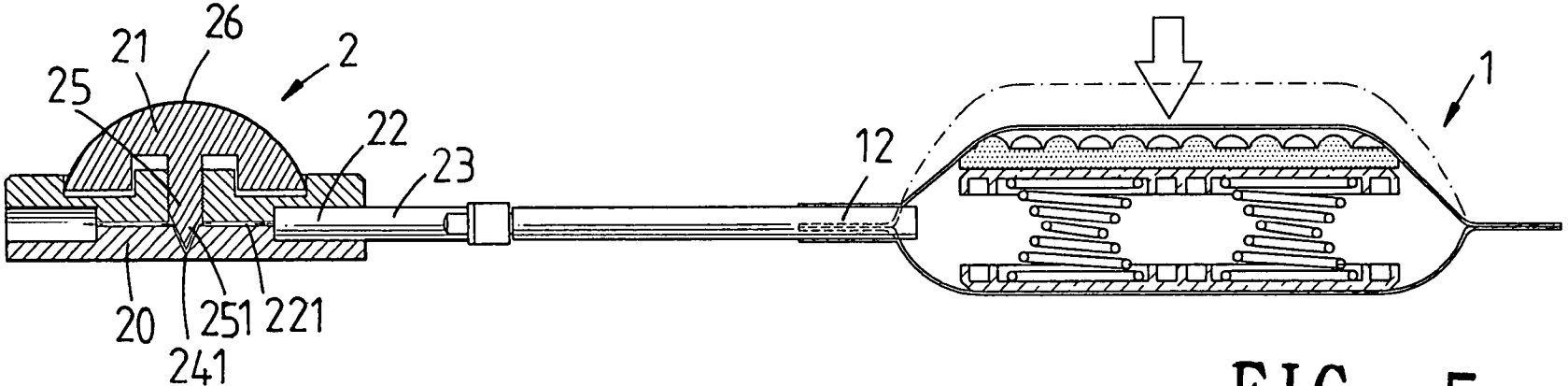

Referring to FIG. 5, when the adjusting button 21 of the adjusting device 2 is released, the screw post 25 will screw out along the screw hole 24. The stopper 251 at a front end of the screw post 25 is screwed out with the screw post 25 so as to retract slightly from the taper space 241. Thereby, the vent 221 has a part of space for receiving air. Then, the buffer portion 10 of the air cushion body 1 can be compressible easily and the elasticity is smaller so that it is suitable for exercises with middle impacts.

Figure 6:
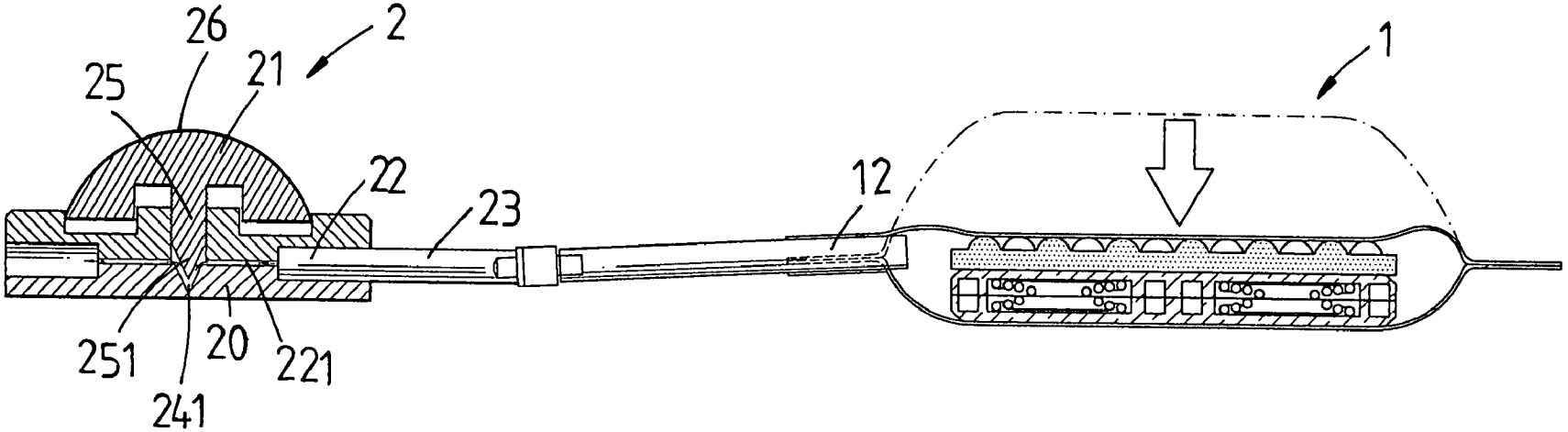
Figure 7:
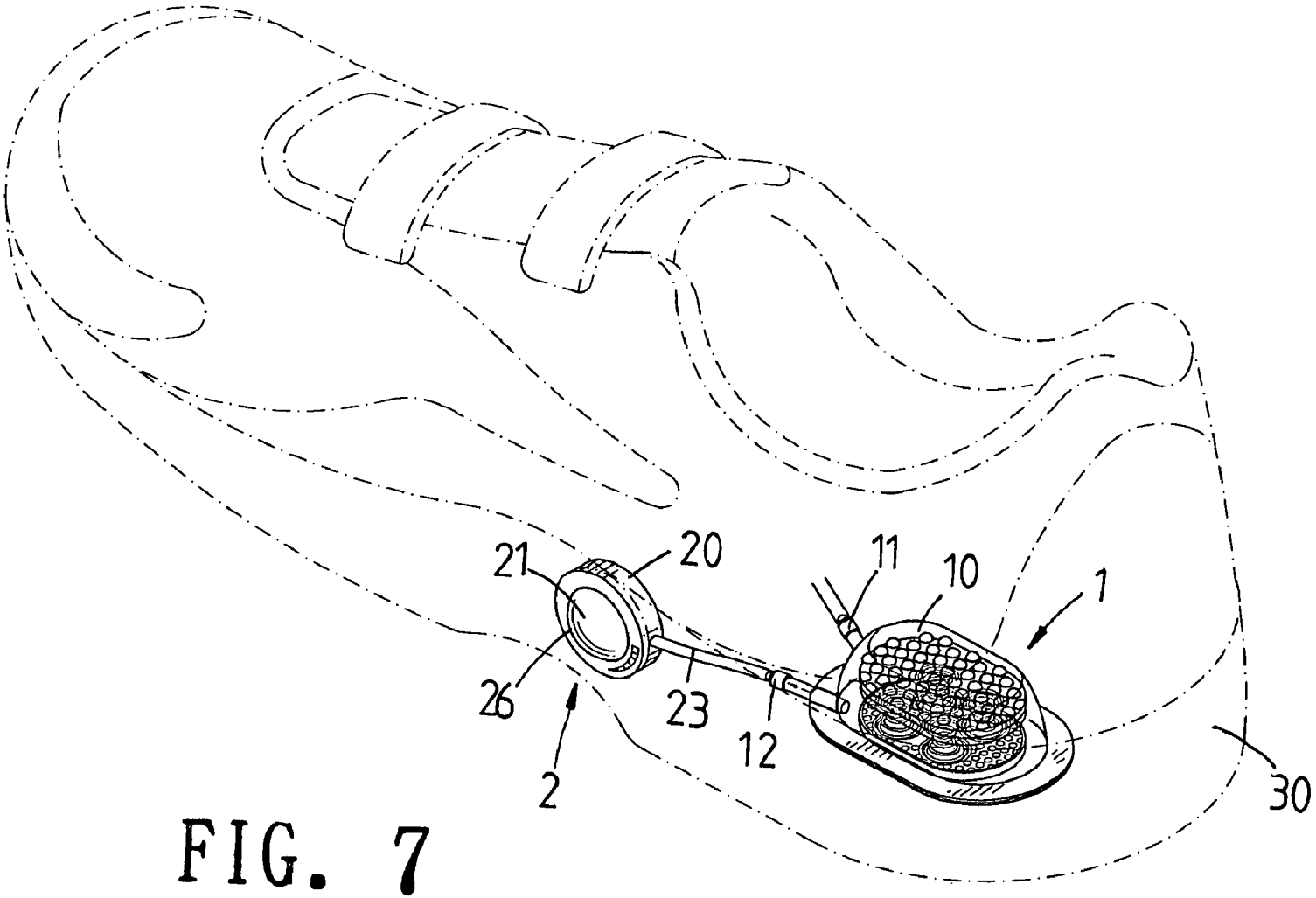
FIGS. 7 and 8 are schematic views showing the assembly of the air cushion of the airflow adjusting device of the present invention.

Referring to FIG. 6, if the adjusting button 21 of the adjusting device 2 is released continuously, the vent 221 will overlap with the stopper 251 so that the buffer portion 10 of the air cushion body 1 will vent air successfully so that the air cushion body 1 can be compressed to a minimum volume. Thereby, at this moment, the present invention can be used to exercises with less impacts. Thereby, the air exhaustion of the buffer portion 10 can be adjusted by the adjusting device 2 so that the buffer portion 10 has different elasticity. Thereby, the user can adjust the elasticity as desired. Thus the shoes using the airflow adjusting device of the present invention can protect the feet With reference to FIG. 7, the air cushion body 1 of the present invention is installed to the sole 30 so that it provides a buffer effect to the feet. The adjusting device 2 is installed at one side of the shoe so that the user can operate the stopper 251 on the cambered lateral surface 26 of the adjusting button 21 and the amount of exhausting air of the vent 221 is controlled so that the buffer portion 10 has different elasticity to match different exercises.

Figure 8:
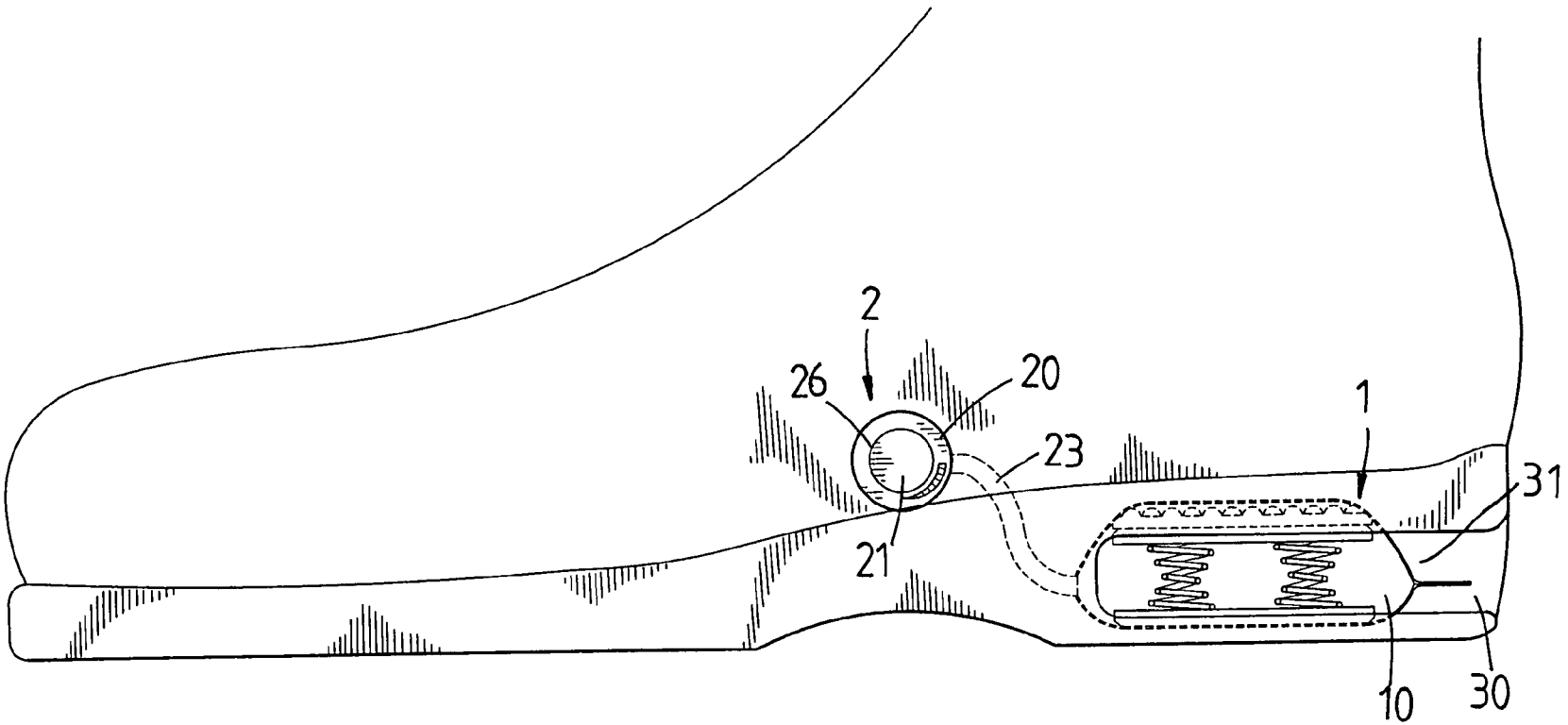

With reference to FIG. 8, in the present invention, a lateral side of the sole 30 can be formed with a transparent window portion 31 so that the compression of the buffer portion 10 can be viewed externally.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An airflow adjusting device of an air cushion shoe comprising:

an air cushion body having a buffer portion, an air inlet connected to the buffer portion and an air outlet connected to the buffer portion; wherein when the buffer portion is impacted, the buffer portion will be compressed and thus induce an elastic force to have a buffer effect; when the buffer portion is compressed, air in the buffer portion will be drained out from the air outlet; when the compressing force disappears, the buffer portion will restore and air is sucked from the air inlet; and an adjusting device including an adjusting seat and an adjusting button on the adjusting seat; and a stopper being formed on the adjusting button for changing air flow rate of the air flowing out of the air outlet so as to change the elasticity of the buffer portion as the adjusting button is actuated; and wherein an exhausting channel penetrates through two sides of the adjusting seat; a middle section of the exhausting channel is formed with an air slot having a smaller diameter than that of the exhausting channel; a guide tube serves to connected the air outlet of the air cushion body with the exhausting channel of the adjusting device; an upper center of the adjusting seat is formed with a screw hole; a tapered space is formed in the adjusting seat and below the screw hole; the tapered space overlaps with one section of the air slot.

2. The airflow adjusting device of an air cushion shoe as claimed in claim 1, wherein a lateral side of the sole is formed with a transparent window portion so that the compression of the buffer portion is visible externally.

* * * * *